United States Patent [19]

Gazapo Santa-Olalla et al.

[11] 4,430,168

[45] Feb. 7, 1984

[54] PROCESS FOR ELECTROLYTICALLY COLORING ALUMINIUM AND THE ALLOYS THEREOF

[75] Inventors: Jose L. Gazapo Santa-Olalla; Juan Gonzalez Feliu, both of Alicante; Isidoro de Miguel Lopez, Albufereta, all of Spain

[73] Assignee: Empresa Nacional del Aluminio, S.A., Madrid, Spain

[21] Appl. No.: 255,665

[22] Filed: Apr. 20, 1981

[30] Foreign Application Priority Data

Apr. 22, 1980 [ES] Spain ..... 490.784

[51] Int. Cl.[3] ..... C25D 11/22

[52] U.S. Cl. ..... 204/35 N; 204/42

[58] Field of Search ..... 204/35 N, 38 A, 58, 204/42

[56] References Cited

U.S. PATENT DOCUMENTS 3,892,636 7/1975 Kaneda et al. ..... 204/35 N 4,042,469 8/1977 Hasegawa et al. ..... 204/42

FOREIGN PATENT DOCUMENTS 52-71349 6/1977 Japan ..... 204/35 N

*Primary Examiner*—G. L. Kaplan

*Assistant Examiner*—William Leader

*Attorney, Agent, or Firm*—Wenderoth, Lind & Ponack

[57] ABSTRACT

The present invention provides an improvement in the process for electrolytically coloring aluminum or an alloy thereof comprising the sequential steps of anodizing, coloring and fixing. In accordance with the improvement, the coloring step is conducted under conditions wherein the ratio between the concentration of the sulphuric acid used and the concentration of the color-producing salt or salts used is from 70:1 to 15:1, the concentration of the sulphuric acid being about 15 g/l and the salts used being metal sulphates, and wherein the peak voltage applied is from 10 to 45 volts and the temperature is about 25° C. and wherein at the beginning of the coloring step of the process, the voltage is increased from 0 up to the peak voltage in a progressive and controlled manner.

4 Claims, 2 Drawing Figures

PROCESS FOR ELECTROLYTICALLY COLORING ALUMINIUM AND THE ALLOYS THEREOF

Figure 1:
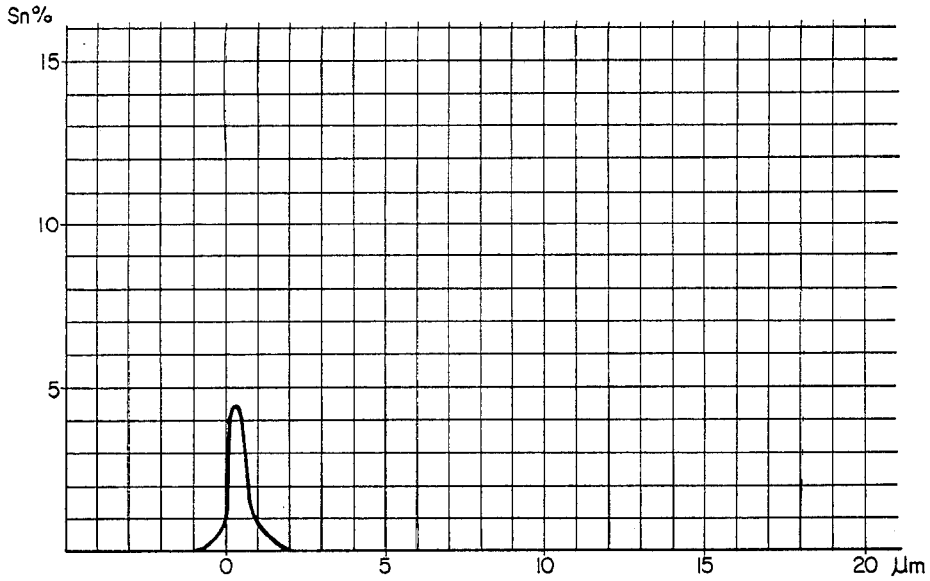

The present invention relates to a process for electrolytically colouring aluminium as well as the alloys thereof.

At present due to the high demand for anodized aluminium in modern architecture and due to the colouring requirements thereof, various processes for producing different colours on anodic layers have been developed.

The processes formerly developed utilised the high absorption capacity of the anodic layers without fixation by determined organic colouring agents and this constituted the process for obtaining different colours on the anodized aluminium. This technique has the advantage that it is possible to obtain practically any colour, although it has the serious disadvantage of the lack of resistance to light of the colours obtained, wherefor said colouring process is not used for outer surfaces.

Another one of the presently known processes is that denominated integral colouring which comprises producing the anodic layer and the colouring in the same bath. At present this technique is expensive since the consumption of energy are high and the treatment times are long.

Finally, there is known a third process, that denominated electrolytic colouring, which comprises, in a first step, producing an anodic layer generally with direct current, and subsequently carrying out with direct or alternating current electrolysis in the colouring bath during which the colouring agent is electrodeposited in the bottom of the pore. This process is cheaper than that of integral colouring and it also has a good resistance to the action of solar light; wherefor this technique is the most widely used at present.

One of the most important disadvantages of the previously mentioned technique is the small variety of colours permitted thereby, since the salts normally used in colouring are nickel, cobalt or tin salts which produce bronze tones and back colourings and copper salts which produce various reddish tones.

This invention relates to a process for producing different colours and tones, other than those obtained with the known two-phase electrolytic colouring process (anodizing and colouring). The colours obtained with the process described in this invention are practically all those of the spectrum in different tones.

Various patents are known in the field of electrolytic colouring for producing novel colours. Thus, German Pats. Nos. 2,106,388 and 2,106,389 describe a process for producing bluish colours which mainly comprises producing electrodepositions on an anodic layer formed of chromic acid, utilising as the colour-producing salts, nickel, cobalt or copper salts and, in turn, fixing the sample under special conditions. These patents have the disadvantage that the colouring can only be produced on samples anodized with chromic acid, which is not a normal practice in industrial plants, and besides fixation should take place under special conditions.

U.S. Pat. Nos. 4,022,671; 4,066,816 and 4,152,222 as well as British patent application No. 2,012,814 describe a process for obtaining a wide range of colours and tones by the optical interference between the light reflected by the colouring agent and that reflected by the surface of the aluminium. These patents describe a series of processes which are mainly characterised in that between the anodizing and colouring steps a reanodizing step is carried out in a bath containing a phosphoric acid solution. Thus, these patents do not follow the known two-phase electrolytic colouring process and, therefore, the use of more baths is necessary, making the process more complicated and substantially increasing the price thereof.

French Pat. No. 2,318,246 produces different colours by the formation of a coloured anodic layer below a colourless anodic layer. This patent is directed to a colouring process of the integral type rather than the electrolytic type, presenting the typical disadvantages of this type of colouring.

Finally, French Pat. No. 2,236,029 by using electrolytes with a high sulphuric acid concentration and various metal salts and organic products in the bath, achieves neutral greyish and bluish colours.

Spanish Pat. No. 437,604, in turn, using high sulphuric acid concentrations and a mixture of cobalt and bismuth salts, achieves the same colours.

As previously mentioned, there is only one process which, in practice, permits a wide range of colours to be obtained. However, it is a complicated process. The process described herein permits a wide range of colours to be obtained in a single colouring process, having a good application in industrial practice and being resistant to the action of solar light.

The process essentially consists of the following steps:

(a) Anodizing with direct current in a bath generally containing sulphuric acid, although other acids, such as oxalic, chromic or mixtures thereof, could be used in this process.

(b) Colouring in a bath which essentially contains sulphuric acid and a metal salt or salts capable of producing colouring.

(c) Fixing of the coloured layer with steam.

Both steps (a) and (c) are normally used in the industry of anodizing and colouring and, therefore, step (b), which is the object of this invention, will be described in greater detail.

It is known and cannot, therefore, be the object of a patent, the production of bronze tones in diluted sulphuric acid solutions with metal sulphates capable of producing colouring. However, the following conditions are necessary to produce different colours:

(1) A sulphuric acid concentration above 15 g/l.

(2) A metal salt concentration which is closely related to the concentration of the acid used.

It has been found that this ratio is ideal when the concentration of the acid used is 15 to 70, although preferably from 20 to 40 times, the concentration of the colour-producing salt or salts will be used. This ratio plays such an important role that if it is too high (above 70), colouring is not produced or the colours produced are light-bronze colours, which do not constitute the object of this invention. However, if the ratio is below 15, either bronze or black colours will be produced or coloured anodic layers will be produced with a very poor adherence to the aluminium, wherefor the process is not applicable.

The metal salts used to produce coloured products will preferably be metal sulphates, such as bismuth, cobalt, nickel, copper and tin, although the best results have been obtained with tin sulphate.

Another important feature of the process is the mode of application of the voltages as well as the values thereof. Thus, voltages lower than 10 peak volts only produce light-bronze colours and voltages higher than 45 peak volts produce light colours, a bad distribution of colours and breakages of the anodic layer. On the other hand, better effects are obtained with a good programming of the rise in voltage that is, when the voltage is increased from zero up to the peak voltage in a progressive manner, than with the application of a constant voltage when producing the colour.

In practice this process produces excellent results by applying the voltages obtained with the system described in Spanish Pat. No. 437,604.

The temperature of this process should be maintained as close as possible to 25° C., although variations in this temperature are not too important.

The mechanism of this process is not completely clear, but it seems that the acidity of the medium plays a very important role together with the electrodeposited pigment, since the assembly of both produces an important modification in the bottom of the anodic layer, which facilitates obtaining a wide variety of colours.

In the process of the instant invention the thickness of the anodic layer is not at all increased during the colouring process.

FIG. 1 illustrates, according to a thickness/concentration graph, the concentration profile of the colour-producing metal, in an analysis carried out with the EDAX technique using samples produced by the process described in this invention. Due to the concentration profile obtained, it is clear that this refers to an electrolytic process wherein a very small amount of the colouring agent was deposited.

Figure 2:
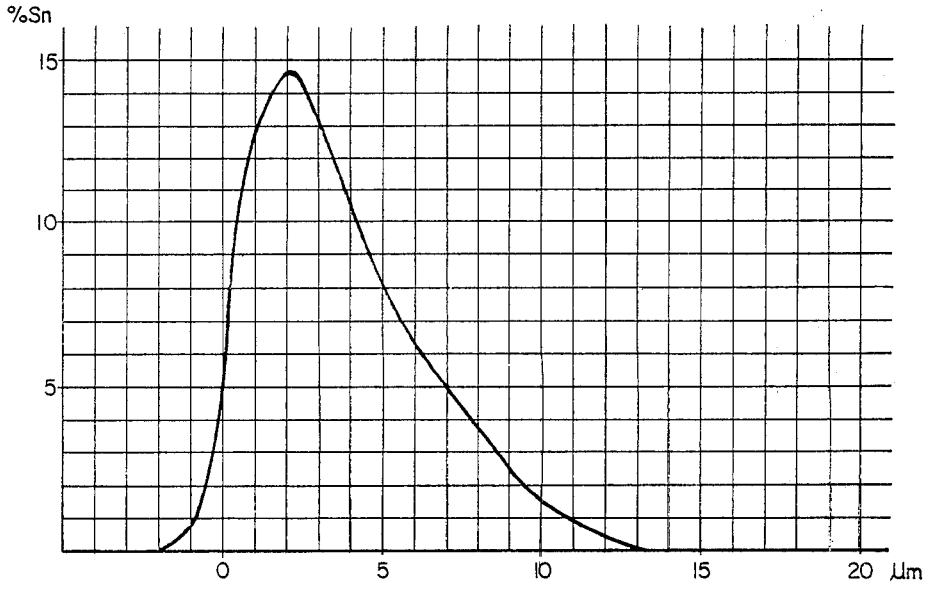

FIG. 2 illustrates the same concentration profile for an electrolytic colouring process in bronze or black. As can be seen, the metal concentration and the height of the pigment are much greater.

With respect to the resistance to light, the colours obtained are more suitable for outer surfaces 100 hours after accelerated tests in URVIAC chambers.

EXAMPLE 1

A sample, previously anodized with direct current in a bath containing sulphuric acid having a thickness of 15 microns, was immersed in a bath containing 150 g of sulphuric acid, 5 g of tin sulphate and 10 g of tartaric acid. A stainless steel plate, acting as the counter-electrode, was placed in the bath and an increase in voltage of from 0 to 25 peak volts in 2 minutes was programmed, this latter voltage being subsequently maintained throughout the process.

The colours obtained are reflected in the following table, depending on the treatment time:

| Treatment time (minutes) | Colour |
|---|---|
| 2 | Light bronze |
| 3 | In-between bronze |
| 4 | Intense blue |
| 5 | Light blue |
| 6 | Intense Green |
| 7 | Yellowish-Green |
| 8 | Yellow |
| 9 | Violet |
| 11 | Blue |

-continued

| Treatment time (minutes) | Colour |
|---|---|
| 14 | Green |

COMPARATIVE EXAMPLE 1

The treatment of the previous Example was carried out, but instead of using 5 g/l of tin sulphate only 0.5 g/l were used. Fourteen minutes after the treatment only a very light-bronze colour was obtained.

COMPARATIVE EXAMPLE 2

A sample was subjected to the same treatment as that described in Example 1, but instead of using 5 g/l of tin sulphate, 20 g/l of the same salt were used. Upon effecting colouring, a complete series of bronze colours were obtained, producing, 14 minutes after treatment, a dark-bronze colour.

EXAMPLE 2

A commercial aluminium sample (1100 for example) was subjected to an anodizing process with direct current in a bath containing sulphuric acid until a thickness of 15 microns was reached. Once the sample was anodized, it was immersed in a bath containing 50 g/l of sulphuric acid, 2.5 g/l of tin sulphate and 20 g/l of tartaric acid, with a stainless steel counterelectrode, programming an increase in voltage of from 0 to 25 peak volts in 4 minutes.

The colours obtained, depending on the treatment time, are reflected in the following table:

| Treatment time (Minutes) | Colour |
|---|---|
| 2 | Light bronze |
| 3 | In-between bronze |
| 5 | Blue-Black |
| 7 | Blue |
| 9 | Green |
| 12 | Yellow |
| 15 | Violet |
| 17 | Blue |
| 20 | Green |

We claim:

1. In a process for electrolytically colouring aluminum or an alloy thereof, comprising the sequential steps of anodizing, colouring, and fixing, the improvement wherein the colouring step is conducted in an electrolyte comprising sulfuric acid and a color-producing salt or salts under conditions wherein the ratio between the concentration of the sulfuric acid and the concentration of the color-producing salt or salts used is from 70:1 to 15:1, the concentration of the sulphuric acid being above 15 g/l and the salts used being metal sulphates, and wherein the peak voltage applied is from 10 to 45 volts and the temperature is about 25° C., and wherein at the beginning of the colouring step of the process the voltage is increased from 0 up to the peak voltage in a progressive manner.

2. A process according to claim 1 wherein said ratio is from 40:1 to 20:1.

3. A process according to claim 1 wherein the metal sulphate employed is selected from the group consisting of bismuth, cobalt, nickel, copper and tin sulphates.

4. A process according to claim 3 wherein tin sulphate is employed.

* * * * *